US006178720B1

(12) United States Patent
Schianchi

(10) Patent No.: US 6,178,720 B1
(45) Date of Patent: Jan. 30, 2001

(54) METHOD AND APPARATUS FOR FORMING STABLE STACKS OF INTRINSICALLY UNSTABLE OBJECTS

(75) Inventor: Mirco Schianchi, Castellarano (IT)

(73) Assignee: Gruppo Elettric 80 Bieffe S.r.l., Viano (IT)

( * ) Notice: Under 35 U.S.C. 154(b), the term of this patent shall be extended for 0 days.

(21) Appl. No.: 09/206,399

(22) Filed: Dec. 7, 1998

(30) Foreign Application Priority Data

Dec. 17, 1997 (IT) ..... RE97A0101

(51) Int. Cl.[7] ..... B65B 27/00; B65B 35/50

(52) U.S. Cl. ..... 53/399; 53/447; 53/588; 53/540

(58) Field of Search ..... 53/588, 556, 399, 53/447, 540, 587, 585

(56) References Cited

U.S. PATENT DOCUMENTS 4,230,519 * 10/1980 Dubroff ..... 53/588 X
4,693,060 * 9/1987 Born ..... 53/588
4,993,209 * 2/1991 Haloila ..... 53/399
5,195,295 * 3/1993 Kurosaki ..... 53/447
5,203,671 * 4/1993 Cawley et al. ..... 53/540
5,447,009 * 9/1995 Oleksy et al. ..... 53/399
5,505,042 * 4/1996 Keip ..... 53/556
5,566,530 10/1996 Johnstone et al. .
5,797,246 * 8/1998 Martin-Cocher et al. ..... 53/399

FOREIGN PATENT DOCUMENTS 2600973 1/1988 (FR) .
1000956 1/1997 (NL) .

* cited by examiner

*Primary Examiner*—Linda Johnson

(57) ABSTRACT

A method and apparatus for depositing objects to form a stack of individual layers, wherein each individual layer is separately formed with a band which extends endlessly about the lateral surface of the layer, said band being of relatively yieldable and manually tearable plastic film having a width not greater than the height of the individual layer. subsequent layers of the stack are formed by depositing objects onto and in contact with a preceding layer as soon as this layer has been bound by said endless band or while it is being wrapped with the endless band.

3 Claims, 4 Drawing Sheets

METHOD AND APPARATUS FOR FORMING STABLE STACKS OF INTRINSICALLY UNSTABLE OBJECTS

BACKGROUND OF THE INVENTION

The present invention relates to the formation of stable stacks of intrinsically unstable objects as mutually superimposed layers in contact with each other, and intended for direct display in a sales outlet.

Currently it is known to form stacks of objects for location, as such, in sales outlets (typically large sales centers) so that the customer can take the objects directly from the stack.

The stack is originally wrapped with a complete covering of plastic sheet which binds the objects together during transport and handling of the stack. The outer covering is removed by personnel of the sales center when the stack has been positioned at the point of display, and in such a manner that the objects are free to be removed from the stack by the customer.

Many objects are intrinsically unstable, i.e., they are either yieldable or, although of sufficient rigidity, have a geometrical shape such as not to allow the formation of stable stacks consisting of layers placed one on another in mutual contact.

In these cases it is usual to place each layer in a tray of sufficiently rigid cardboard, which forms both a base for the objects and vertical wall which retains them along the lateral surface of the layer. The layers hence rest one on another with the trays therebetween.

Besides being costly in themselves, these trays also require the intervention of the sales center personnel for their removal as the layers of objects gradually become consumed. Moreover, such trays involve a disposal cost as refuse.

SUMMARY OF THE INVENTION

An object of the present invention is to provide a method, an apparatus or plant and a type of stack, which overcome the above drawbacks.

The method of the present invention comprises the following operations, in sequence and repeated for an indeterminate number of cycles:

depositing objects to form an individual stack layer extending in a substantially horizontal plane, then wrapping the layer just formed with a band extending endlessly about the lateral surface of the layer, said band being of relatively yieldable and hand-tearable plastic film having a width not greater than the height of the individual layer, then, to form a further layer of the stack, depositing objects onto and in contact with the preceding layer as soon as this has been bound by said endless band or while the wrapping thereof is taking place.

According to a preferred embodiment, particularly when the objects are particularly yieldable, at the vertical corners of the layer of objects there are positioned vertical rods about which the band is wrapped, after which said rods are extracted vertically from the band, to leave this extending around the layer of objects.

DESCRIPTION OF THE DRAWINGS

Present invention is described in detail hereinafter with the aid of the accompanying figures which illustrate a non-exclusive embodiment of the plant for implementing the method of the present invention, wherein.

DETAILED DESCRIPTION OF THE INVENTION

Figure 1:
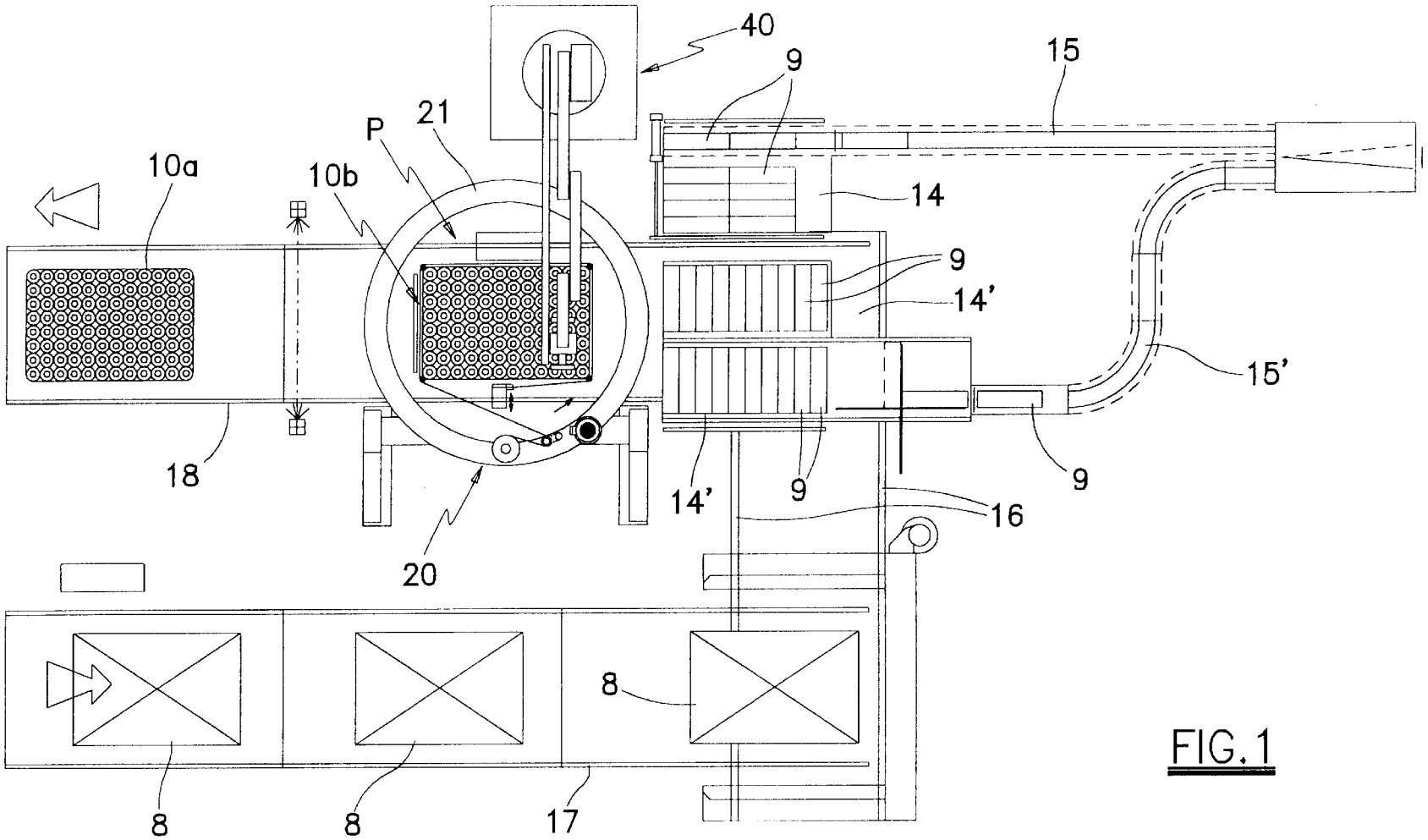
FIG. 1 is a general plan view of the plant.
Figure 2:
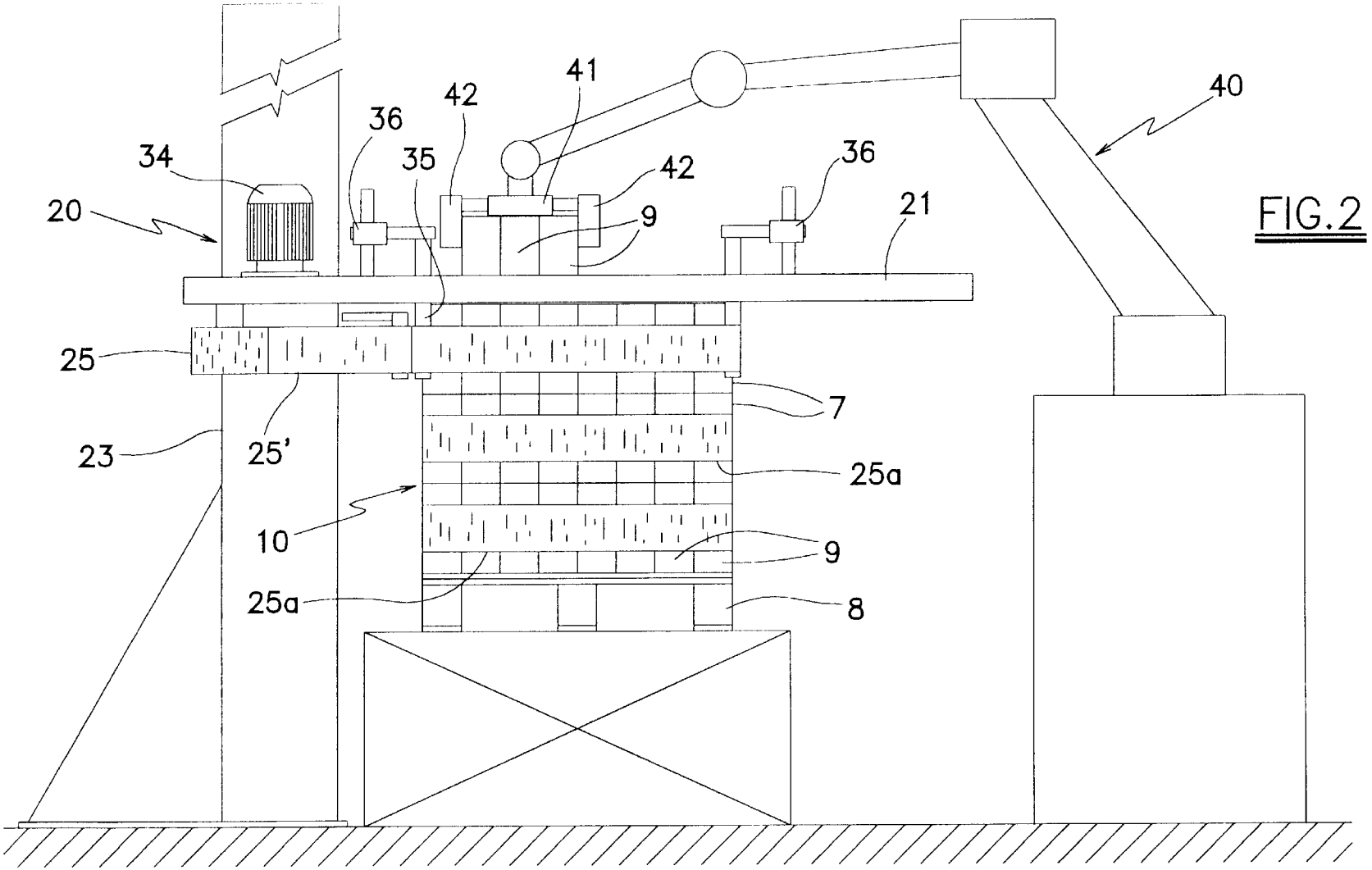
FIG. 2 is a vertical elevation of the layer-wrapping machine of FIG. 1.
Figure 3:
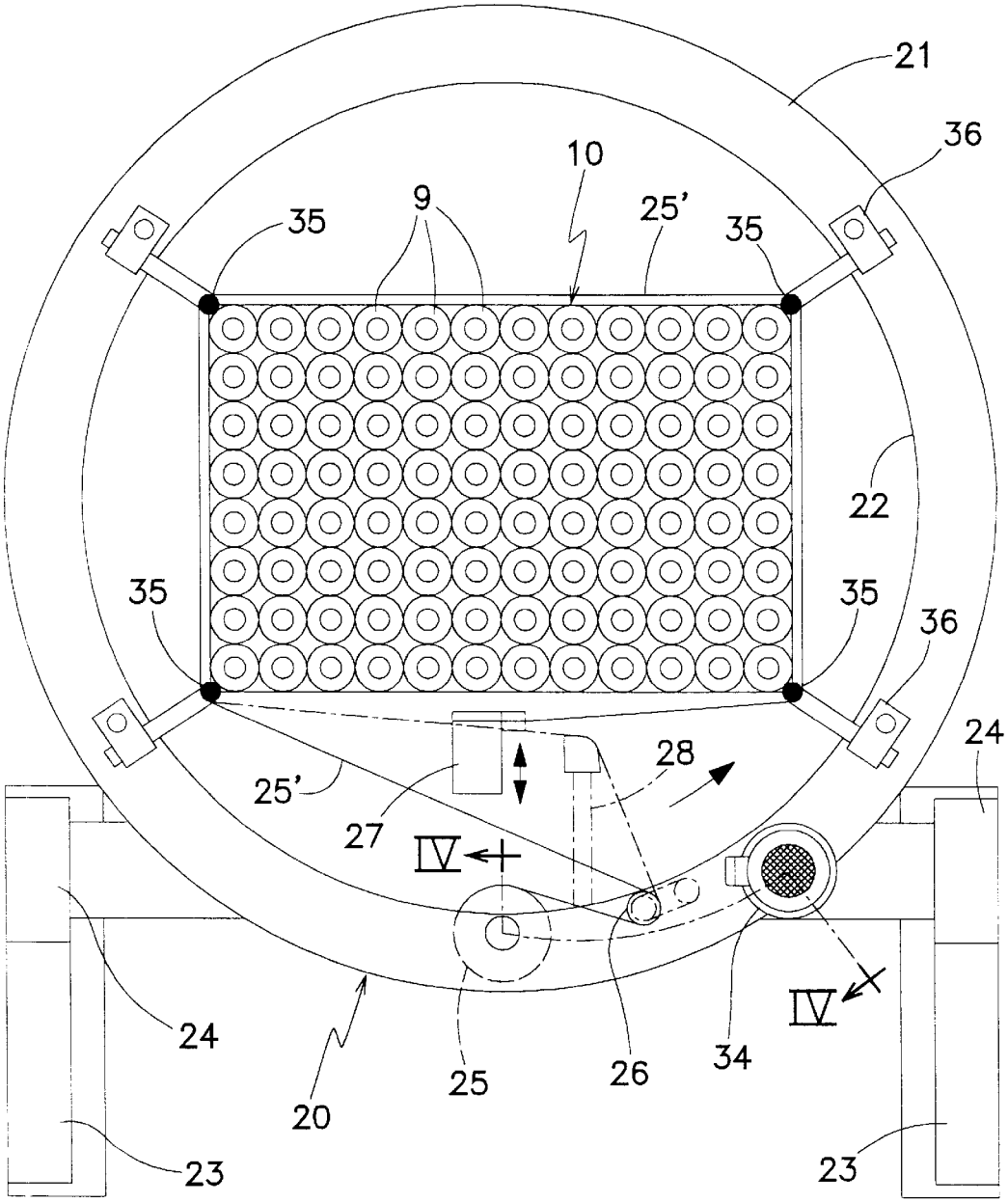
FIG. 3 is a detailed plan view of FIG. 1 from above.
Figure 4:
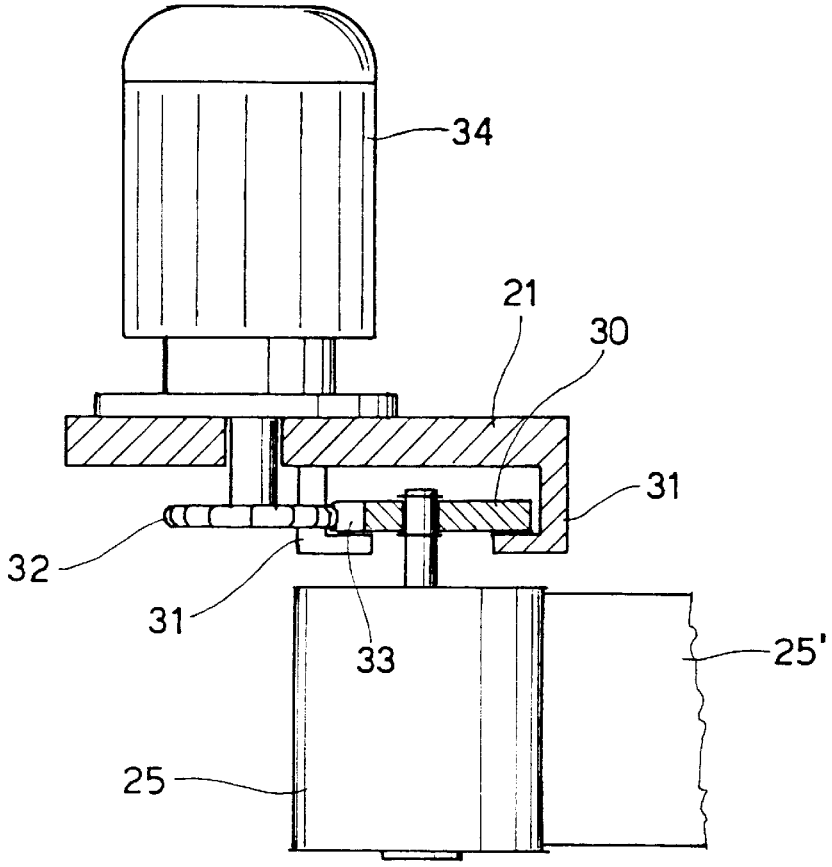
FIG. 4 is a section taken along the plane IV—IV of FIG. 3.

The plant comprises a layer-wrapping machine 20 operating on a stack under formation.

The stack (indicated by 10 in the figures) is formed of layers of objects 9, the layers being mutually superimposed and in contact with each other. The objects are of the intrinsically unstable type, for example, as shown in the figures, rolls of paper, which are relatively yieldable and hence incapable in themselves of forming a stable stack.

The stack 10 is formed on a relative usual pallet 8 positioned in a fixed station P, for example on a roller table 18.

The pallets 8 are fed close to the fixed station P by a roller conveyor 17 and then transferred to the downstream end of the roller table 18 by a transfer means 16.

Close to the station P there are positioned a machine 40 for forming the layers of objects on the stack, and a machine 20 for wrapping the individual layers of the stack.

The objects are fed close to the station P by means of one or more conveyors 15, 15' and are collected into prearranged groups on relative ramps 14 and 14' positioned within the radius of action of the forming machine 40.

The machine 40 is preferably a robot machine (of known type) having a movable head 41 arranged to grip, for example by means of jaws 42, individual groups of objects from the ramps 14, 14'.

The machine 20 comprises a vertically movable frame 21 in the form of a flat ring arranged in a horizontal plane and having a central aperture 22 (defined by the internal circular edge) which, when viewed in plan, encloses within its interior the outline of the stack 10.

In particular, the frame 21 is in the form of a plate of constant thickness, with a circular rim profile.

The frame 21 is carried by two slide blocks 24 coupled to two support columns 23 fixed to the floor. The slide blocks 24 are coupled to the columns 23, to slide vertically, driven by suitable motor means (of known type, not shown in the figures), in order to shift the frame 21 upwards stepwise as the stack of objects becomes formed.

With the frame 21 there is associated a means 30 arranged to slide along the frame perimeter.

In particular, in the embodiment shown in the figures, said means 30 is in the form of a flat ring concentric with the frame 21 and facing the lower surface thereof. The ring 30 is retained and guided by guides 31 joined to the lower surface of the frame 21 and projecting downwards, to engage both the inner circular edge and the outer circular edge of the ring. A gearwheel 32, driven by a geared motor 34, engages a toothing 33 extending along the outer circular edge of the ring 30.

The ring 30 carries a reel 25 of plastic film, of vertical axis, from which there emerges a web 25' of height not greater than the height of an individual layer of the stack, to wrap the lateral surface of each individual layer with an endless band. With the reel 25 there is associated a roller 26 also carried by the ring 30 and about which the web 25' leaving the reel 25 partially winds before being wrapped about the stack 10. The purpose of the roller 26 is to guide and brake the web 25' to achieve the correct wrapping tension.

A clamping means 27 carried by the frame 21 retains the initial end of the web 25' close to one side of the stack 10. Another means 28, also carried by the frame 21, urges the web 25' against the initial portions and bonds the two web portions together and cuts them to separate the web 25' from the band which has just been formed about the layer of objects.

The machine 40 for depositing the objects onto the stack operates by transferring them from above downwards onto the forming stack through the central aperture 22 of the ring frame 21.

The method implemented by the aforedescribed plant is as follows.

A pallet 8 is initially positioned in the station P by the conveyor 17 and the transfer means 16. The objects 9 to be stacked are fed to the ramps 14 and/or 14', where they are gripped by the machine 40 and deposited in programmed order onto the pallet 8 until a single stack layer is formed extending in a substantially horizontal plane. The objects are deposited through the central aperture of the frame 21 of the machine 20, which is positioned above and at a short distance from the pallet 8.

When the layer of objects 7 on the pallet is complete, the machine 20 is operated to form, by means of the web 25' from the reel 25, a band 25*a* which wraps and hugs in the manner of a belt the lateral surface of the layer, the band being of relatively yieldable and hand-tearable plastic film having a width not greater than the height of the individual layer.

Advantageously, at the vertical corners of the layer of objects just formed there are positioned vertical rods 35, in particular of circular cross-section, about which the band 25*a* is wrapped. This prevents excessive deformation of the layer configuration, especially if the objects are formed of very yieldable material or are very light in weight. Said rods 35 are later withdrawn vertically from the band 25*a,* leaving the band extending about the layer of objects.

The rods are each supported by a suitable support member 36 of the adjustable type, positioned on the upper surface of the ring fame 21.

Figure 5:
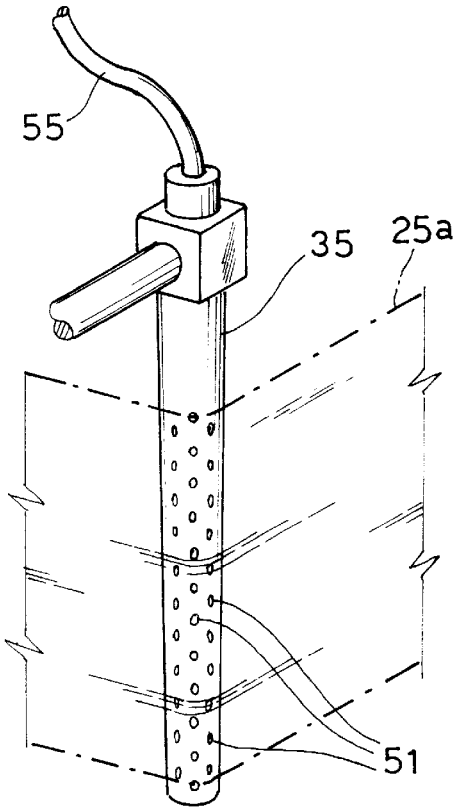
FIG. 5 is a perspective view of a machine detail relative to the rods 35 positioned at the vertical corners of the layer of objects.

In a preferred embodiment, the rods 35 are internally hollow and their internal cavity is connected to a compressed air feed pipe 55 (see FIG. 5). On that part of their lateral surface which makes contact with the band 25*a,* the rods possess small through holes 51 through which compressed air present in the cavity of the rod 25 passes with outward force. This air strikes the band 25*a* in that region in which it partially wraps around the rod 35 and, as this tends to separate the band 25*s* from the rod 35, the withdrawal of the rod from the band facilitated. Furthermore, and again to facilitate this withdrawal, the rods 35 are slightly inclined from the vertical so that they converge downwards towards the center of the stack.

As soon as a layer has been bound by the endless band 25*a* or while stilling being wrapped by this band, the next layer of objects is formed by depositing objects 9 onto and in contact with the preceding layer.

As in the case of the preceding layer, the second layer of objects 9 is deposited through the central aperture of the ring frame 21.

The required stack of objects is obtained by proceeding in the aforedescribed manner for an indeterminate number of cycles. When completed, the stack 10 is withdrawn along the roller table.

In FIG. 1 the reference numeral 10*a* indicates a formed stack which has been withdrawn, and 10*b* indicates a stack under formation, positioned in the station P.

The stack 10 obtained comprises a plurality of mutually superposed layers 7 of objects 9, each layer bound by a band 25*a* extending endlessly about the lateral surface of the layer 7, the band being of relatively yieldable and hand-tearable plastic film. In this manner a stack is obtained which is stable both during its formation and when brought into a sales center.

When in the sales center the stack 10 leaves its objects 9 accessible to the public, in that they can be withdrawn in the upward direction from the highest bound layer. As the objects become gradually depleted from the highest layer 7, the band 25*a* slackens and can be removed.

Alternatively the band can be torn away to leave the objects free from confinement by the band.

When a layer of objects 9 has been consumed, the underlying layer remains totally accessible to the customer.

Numerous modifications of a practical and applicational nature can be made to the invention, but without leaving the scope of the inventive idea as claimed below.

What is claimed is:

1. A method for forming stable stacks of intrinsically unstable objects as mutually superimposed layers in contact with each other which comprises depositing objects in a substantially horizontal plane to form an individual layer, wrapping the layer just formed with a band extending endlessly about the lateral surface of the layer, said band being of relatively yieldable and hand-tearable plastic film having a width not greater than the height of the individual layer, and forming additional layers to create a stack, by depositing objects onto and in contact with the preceding layer as soon as the preceding layer has been bound by said endless band or while the wrapping is taking place, each band wrapped around each layer being independent of bands wrapped around other layers, wherein substantially vertical rods are positioned at the corners of the layer of objects, said rods being wrapped when said layer is wrapped, and vertically removing said rods from the band, to leave the band extending around the layer of objects.

2. An apparatus for forming a stable stack of intrinsically unstable objects as mutually superimposed layers in contact with each other which comprises a vertically movable annular frame in the form of a flat ring arranged in a horizontal plane and having a central aperture, reel means arranged to slide along the perimeter of the annular frame said reel carrying plastic film having a height not greater than that of each individual layer of the stack, for wrapping the lateral surface of each individual layer with an endless band of said plastic film, and stacking means for depositing the objects to be stacked through the central aperture of the ring frame, wherein vertical rods are operatively connected to the annular frame for being placed at the vertical corners of the layer of objects, said band being wrapped around said layer and said rods, said rods being later withdrawn vertically from the band leaving the plastic film extending about the layer of objects.

3. The apparatus of claim 1, wherein the vertical rods are internally hollow and contain a plurality of surface apertures, and means are provided for introducing compressed air into said hollow rods and through said surface apertures to facilitate the removal of the rods from the stack.

* * * * *